US007307379B2

(12) United States Patent
Iwamatsu et al.

(10) Patent No.: US 7,307,379 B2
(45) Date of Patent: Dec. 11, 2007

(54) ELECTRON EMITTING ELEMENT AND IMAGE FORMING APPARATUS EMPLOYING IT

(75) Inventors: Tadashi Iwamatsu, Nara (JP); Hiroyuki Hirakawa, Nara (JP); Nobuyoshi Koshida, 3-12-8, Midori-cho, Koganei-shi (JP) 184-0003

(73) Assignees: Sharp Kabushiki Kaisha, Osaka (JP); Nobuyoshi Koshida, Tokyo (JP)

( * ) Notice: Subject to any disclaimer, the term of this patent is extended or adjusted under 35 U.S.C. 154(b) by 302 days.

(21) Appl. No.: 10/550,750

(22) PCT Filed: Apr. 13, 2004

(86) PCT No.: PCT/JP2004/005278

§ 371 (c)(1),
(2), (4) Date: Sep. 23, 2005

(87) PCT Pub. No.: WO2004/095146

PCT Pub. Date: Nov. 4, 2004

(65) Prior Publication Data

US 2006/0186786 A1 Aug. 24, 2006

(30) Foreign Application Priority Data

Apr. 21, 2003 (JP) ..... 2003-116091

(51) Int. Cl.
*H01J 1/62* (2006.01)

(52) U.S. Cl. ..... 313/495; 313/310

(58) Field of Classification Search ..... 313/309, 313/310, 336, 351, 495, 498
See application file for complete search history.

(56) References Cited

U.S. PATENT DOCUMENTS 6,249,080 B1 6/2001 Komoda et al.

FOREIGN PATENT DOCUMENTS

JP 06-255168 9/1994

(Continued)

OTHER PUBLICATIONS

Y. Yamaguchi, et al. *Application of Carbon Nanotube to Electron Beam Source for Imaging*, Department of Physics and Elecronics, Osaka Prefectur University, pp. 221-224.

(Continued)

*Primary Examiner*—Vip Patel
(74) *Attorney, Agent, or Firm*—David G. Conlin; David A. Tucker; Edwards Angell Palmer & Dodge LLP

(57) ABSTRACT

An electron emitting element is of a structure in which a semiconductor layer is formed between an upper electrode and a lower electrode, wherein an organic compound adsorption layer is formed on a semiconductor surface of the semiconductor layer by causing the organic compound to be adsorbed on the semiconductor surface. Herein, the semiconductor layer can be made of silicon or polysilicon and partly or as a whole porous. The absorbed organic compound can be a non-cyclic hydrocarbon, a compound obtained by coupling at least an aldehyde group to a non-cyclic hydrocarbon, or a non-cyclic hydrocarbon having an unsaturated bond. As a result, there can be provided an electron emitting element capable of stably operating in the atmosphere or in a low vacuum even when being operated in the atmosphere or in the low vacuum and an imaging device using the electron emitting element.

13 Claims, 8 Drawing Sheets

FOREIGN PATENT DOCUMENTS

| | | |
|---|---|---|
| JP | 08-250766 | 9/1996 |
| JP | 11-329213 | 11/1999 |
| JP | 2000-019921 | 1/2000 |
| JP | 2001-313151 | 11/2001 |
| JP | 2001-357961 | 12/2001 |
| JP | 2002-174943 | 6/2002 |
| JP | 2002-258585 | 9/2002 |
| JP | 2002-311683 | 10/2002 |
| JP | 2004-265603 | 9/2004 |
| JP | 2004-266089 | 9/2004 |

OTHER PUBLICATIONS

Y, Nakajima, et al. "*A Novel Solid-State Light-Emitting Device Based on Ballistic Electron Excitation*", Materials Research Society, 2001, vol. 638, pp. 17-22.

Y. Yamaguchi, et al. *Development of High Electron Source for Image Recording with Carbon Nanotube*; Japan Hardcopy 97, The Imaging Society of Japan; Jul. 1997; pp. 221-224 w/English language translation.

ELECTRON EMITTING ELEMENT AND IMAGE FORMING APPARATUS EMPLOYING IT

TECHNICAL FIELD

The present invention relates to an electron emitting element capable of stably operating for a long period of time even in the atmosphere, and an imaging device using the same.

BACKGROUND ART

A Spindt-type electrode, a carbon nanotube (CNT)-type electrode and the like have been known as conventional cold cathode-type electron emitting elements, which have been studied on applications to the field of FED (Field Emission Display). The elements are operated in such a manner that a voltage is applied to a pointed end to form a strong electric field of about 1 GV/m and to emit electrons with the help of a tunneling effect.

There has been heretofore present an idea that such an electron emitting element is operated in the atmosphere and applied to a charger or an electrostatic latent image forming device. For example, there has been proposed a method in which a Spindt-type cold cathode is operated in the atmosphere to emit electrons into the atmosphere, to ionize gas molecules into ions as charged particles and to form an electrostatic latent image (see Japanese Laid-Open Patent Publication No. 06-255168). Besides, the result of a research on a carbon nanotube operated in the atmosphere has been reported (see Yamaguchi and three others, "Development of High Efficiency Electron Source for Image Recording with Carbon Nanotube," Japan Hardcopy 97 articles, The Imaging Society of Japan, July 1997, pp 221-224). As seen from the documents, suggestion has been given on a possibility of applying an electron emission element as an electron source for an electrophotograph charger or electrostatic latent image forming device.

The two types of electron emitting elements, however, have a strong electric field in the vicinity of a surface of an electron emitting section as described above, which makes it easy that emitted electrons acquire energy larger than the electric field to ionize gas molecules. This has resulted in a problem that plus ions generated by ionization of gas molecules are accelerated by the strong electric field in the direction toward the element surface and collide with the element surface, causing element breakdown due to sputtering.

There have been known other type cold cathodes such as an MIM (Metal Insulator Metal) type and an MIS (Metal Insulator Semiconductor) type. Those are a surface emission-type electron emitting element working in a way such that electrons are accelerated using a quantum size effect and a strong electric field and caused to be emitted from a flat element surface. The electron emitting elements have no necessity for a strong electric field outside of the element since electrons are accelerated inside of the element and emitted. Hence, an electron emitting element of the MIM type or the MIS type can solve a problem that the element is broken down by sputtering through ionization of gas molecules, which occurs in the electron emitting element of the Spindt type or the CNT type.

An electron emitting element in which electrons injected into a porous semiconductor are accelerated in an electric field, forced to pass through a surface metal thin film with the help of a tunneling effect and finally emitted into a vacuum has been proposed as an electron emitting element belonging to the MIS type using a quantum size effect of a porous semiconductor (for example, porous silicon) formed by an anodic oxidation treatment on a semiconductor (see Japanese Laid-Open Patent Publication No. 08-250766). A cold cathode made of such a porous semiconductor has a great merit that an element can be fabricated by means of an extremely simple, convenient, low-cost method adopting anodic oxidation.

In a case where such an element is operated in the atmosphere, however, a problem has newly occurred that various gas molecules are adsorbed on a surface of the element to change an electric characteristic or the like of the semiconductor and to thereby reduce an electron emission current.

The surface of a cold cathode of the MIM type or the MIS type inside which element electrons are accelerated is constituted generally of a metal thin film playing a role as an upper electrode applying an electric field to the inside of the element. Since electrons accelerated in the inside of the element, however, are emitted into a vacuum tunneling through the surface metal thin film, an tunneling effect enhanced with a smaller film thickness increases an electron emission quantity. A thickness of the metal film by which the two roles are established simultaneously has been appropriate in the range of from several nm to tens of nm. For example, in Japanese Laid-Open Patent Publication No. 08-250766, there is disclosed an example with a thickness of a metal thin film of 15 nm.

Cold cathodes of the MIM type and the MIS type have difficulty forming a dense metal film because of a very thin film on the surfaces thereof and almost no barrier effect to gas molecules is exerted. Therefore, in a case where an electron emitting element is operated in the atmosphere, a problem arises that gas molecules intrude into an inside semiconductor layer to change an electric characteristic or the like of the semiconductor to thereby reduce an electron emission current.

DISCLOSURE OF THE INVENTION

It is an object of the present invention to provide an electron emitting element capable of stably operating in the atmosphere or in a low vacuum by solving the above problems when being operated in the atmosphere or in the low vacuum, and to provide an imaging device using the electron emitting element.

The electron emitting element according to the present invention, in order to achieve the object, is directed to an electron emitting element of a structure in which a semiconductor layer is formed between an upper electrode and lower electrode, wherein an organic compound adsorption layer is formed on a semiconductor surface of the semiconductor layer by causing the organic compound to be adsorbed on the semiconductor surface. The semiconductor layer here is made of silicon or polysilicon and part or the whole thereof can be made porous. The organic compound can be a straight-chain or branched non-cyclic hydrocarbon having 7 or more carbon atoms in a molecule, a compound obtained by coupling at least an aldehyde group to a non-cyclic hydrocarbon, or a non-cyclic hydrocarbon having at least one unsaturated bond in a molecule.

The imaging device according to the present invention is directed to an imaging device using the electron emitting element according to the present invention as a charger, wherein an electrostatic latent image carrier is charged by emitting electrons from the electron emitting element in the atmosphere. The imaging device according to the present invention is directed to an imaging device using the electron emitting element according to the present invention as a charge feed device, wherein a latent image is formed directly on an electrostatic latent image carrier by emitting electrons from the electron emitting element in the atmosphere.

According to the present invention, as described above, an electron emitting element in which a semiconductor layer is formed between an upper electrode and lower electrode is constructed and an organic compound is caused to be adsorbed on a semiconductor surface of the semiconductor layer, thereby enabling an electron emitting element capable of stably operating even in the atmosphere to be provided and further an imaging device using the electron emitting element to be provided.

BEST MODES FOR CARRYING OUT THE INVENTION

Figure 1:
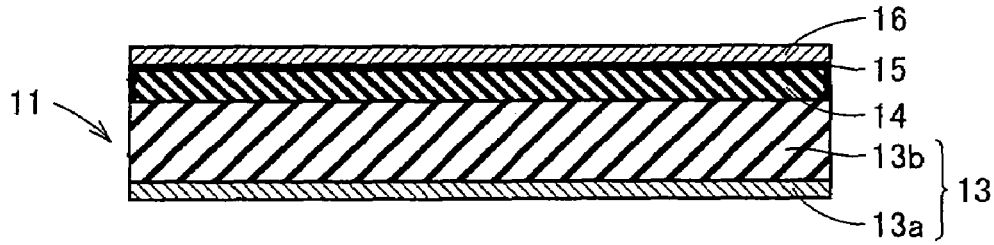
FIG. 1 is a schematic view showing an electron emitting element according to the present invention.
Figure 2:
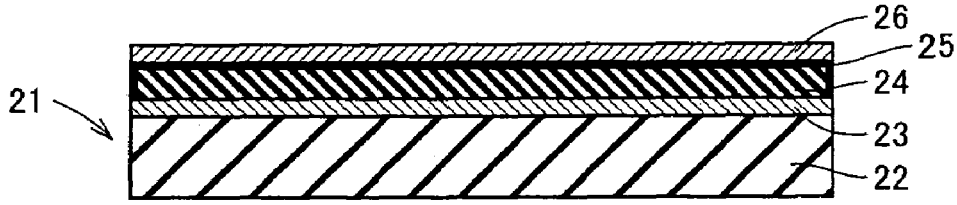
FIG. 2 is a schematic view showing another electron emitting element according to the present invention.

With reference to FIG. 1 or 2, an electron emitting element according to the present invention is an electron emitting element 11 or 12 of a structure in which a semiconductor layer 14 or 24 is formed between an upper electrode 16 or 26 and a lower electrode 13 or 23, characterized by that an organic compound is caused to be adsorbed on a semiconductor surface of the semiconductor layer to thereby form an organic compound adsorption layer 15 or 25. By causing an organic compound to be adsorbed on the semiconductor surface, the semiconductor surface is stabilized, gas molecules in the atmosphere is prevented from being adsorbed on the semiconductor surface and a change in electric characteristic caused by the gas molecules and reduction in electron emission current of the electron emitting element can be suppressed. No specific limitation is placed on a thickness of the organic compound adsorption layer as far as it does not affect adversely the object of the present invention, and the thickness is preferably as thin as possible on the order of a monomolecular layer from the viewpoint of an electron emission characteristic of the electron emitting element. An organic compound is adsorbed at a portion having adsorption activity on a semiconductor surface (for example, a hydrogen terminal on a polysilicon semiconductor surface) to form an organic compound adsorption layer and to thereby enable the semiconductor surface to be stabilized; therefore, in the present invention, the organic compound adsorption layer has only to be formed on at least portions with adsorption activity on the semiconductor surface and is not required to completely cover the entire semiconductor surface.

The semiconductor layer of the electron emitting element according to the present invention can be a porous silicon semiconductor layer or a porous polysilicon semiconductor layer in which part or all of silicon or polysilicon is made porous. A porous silicon semiconductor layer obtains a large emission current, while a porous polysilicon semiconductor layer greatly improves thermal stability. A porous semiconductor layer is high in effect of semiconductor surface stabilization with adsorption of an organic compound. Herein, the term, polysilicon, means polycrystalline silicon.

In a case where a semiconductor layer is porous, a semiconductor surface includes not only a surface of the semiconductor layer, but also a semiconductor surface in the inside of the semiconductor layer on which an organic compound can be adsorbed by way of holes formed inside the semiconductor layer. That is, in a case where semiconductor is porous, an organic compound is adsorbed on the semiconductor layer and thereby, not only is organic compound adsorption layer 15 or 25 formed on a surface of semiconductor layer 14 or 24 shown in FIG. 1 or 2, but an organic compound adsorption layer (not shown) is also formed on the semiconductor surface in the inside of the semiconductor layer.

An electron emitting element of the present invention can use a non-cyclic hydrocarbon as the organic compound. A non-cyclic hydrocarbon can be adsorbed on a semiconductor surface of a semiconductor layer to thereby cause hydrophobicity to exerted. Thereby water molecules in the atmosphere can be prevented from intruding into the semiconductor layer and an oxidation reaction of a semiconductor layer with water molecules can also be prevented from occurring, which makes it possible to suppress a change in electric characteristic and reduction in electron emission current of an electron emission element. Since a non-cyclic hydrocarbon is less in steric hindrance as compared with a cyclic hydrocarbon, the non-cyclic hydrocarbon can be adsorbed on a semiconductor surface at a higher density, thereby hydrophobicity of the semiconductor surface can be raised.

An electron emitting element according to the present invention can use a straight-chain or branched non-cyclic hydrocarbon having 7 or more carbon atoms as the non-cyclic hydrocarbon. Such a non-cyclic hydrocarbon is attached to a semiconductor surface and becomes a saturated hydrocarbon to thereby form a chemically stable semiconductor surface extremely low in reactivity with an oxidant, a reductant, an acid or a base. The term, a branched non-cyclic hydrocarbon, means a non-cyclic hydrocarbon having at least one branching.

An electron emitting element according to the present invention can use a compound obtained by coupling at least an aldehyde group to the non-cyclic hydrocarbon as the organic compound. In a case of a non-cyclic hydrocarbon, or especially in a case where a non-cyclic hydrocarbon is a saturated hydrocarbon, the hydrocarbon is poor in reactivity with a surface of semiconductor such as silicon to render chemical adsorption thereof difficult. In such a case, when a compound with an alkyl group coupled with an aldehyde group as a functional group is forced to act on a semiconductor surface such as silicon surface, an aldehyde group with a high reactivity reacts and is adsorbed on the semiconductor surface to enable a structure in which the semiconductor surface is surrounded with alkyl groups to be realized. If a non-cyclic compound having carbon atoms in number exceeding 17 is used, a proportion of aldehyde groups contained in the compound decreases, which in turn, reduces chemical adsorptivity to a semiconductor layer surface.

Examples of compounds obtained by coupling an aldehyde group to the above-mentioned non-cyclic hydrocarbon includes: n-octanal ($CH_3(CH_2)_6CHO$), n-decanal ($CH_3(CH_2)_8CHO$), n-dodecanal ($CH_3(CH_2)_{10}CHO$), 6-methylpeptanal ($(CH_3)_2CH(CH_2)_4CHO$), 11-methyldodecanal ($(CH_3)_2CH(CH_2)_{10}CHO$) and others.

An electron emitting element according to the present invention can use a non-cyclic hydrocarbon having at least one unsaturated bond as the non-cyclic hydrocarbon. Especially, in a case where a non-cyclic hydrocarbon is a saturated hydrocarbon, the hydrocarbon is poor in reactivity with a surface of semiconductor such as silicon, resulting in difficulty of chemical adsorption. In such a case, when a non-cyclic hydrocarbon having at least one unsaturated bond such as a double bond or a triple bond having a high reactivity is forced to act on a surface of semiconductor such as silicon, portions of double bonds or triple bonds having a high reactivity react with and are adsorbed on the semiconductor surface to enable a structure in which the semiconductor surface is surrounded with alkyl groups to be realized. If a non-cyclic hydrocarbon, with an unsaturated bond, and having carbon atoms in number exceeding 17 is used, a proportion of unsaturated bonds contained in the non-cyclic hydrocarbon decreases, leading to reduction in chemical absorptivity to a semiconductor surface.

Examples of non-cyclic hydrocarbons having the unsaturated bond include: 1-octene ($CH_3(CH_2)_5CH{=}CH_2$), 1-decene ($CH_3(CH_2)_7CH{=}CH_2$), 1-dodecene ($CH_3(CH_2)_9CH{=}CH_2$), 1-hexadecene ($CH_3(CH_2)_{13}CH{=}CH_2$), 6-methyl-1-heptene ($(CH_3)_2CH(CH_2)_4CH{=}CH_2$), 2-methyl-1-nonene ($CH_3(CH_2)_6C(CH_3){=}CH_2$), 11-methyl-1-tridecene ($(CH_3)_2CH(CH_2)_8CH{=}CH_2$), 2,4-dimethyl-1-heptene ($CH_3(CH_3)_2CH\ (CH_3)CH_2C(CH_3){=}CH_2$), 1,7-octadiene ($CH_2{=}CH(CH_2)_4CH{=}CH_2$), 1,3-decadiene ($CH_3(CH_2)_5CH{=}CH{-}CH{=}CH_2$) and others.

An electron emitting element according to the present invention can use a straight chain or branched non-cyclic unsaturated aldehyde compound expressed in a formula of $C_2H_{2n-1}CHO$ (n is an integer ranging from 7 to 17) as a compound obtained by coupling an aldehyde group to the above-mentioned non-cyclic hydrocarbon. With the presence of an aldehyde group and an unsaturated bond in a molecule, a reactivity with a semiconductor surface further increases, thereby enabling a stronger chemical adsorption to be realized. Examples of such compounds include: 2-octenal ($CH_3(CH_2)_4CH{=}CHCHO$), 2-decenal ($CH_3(CH_2)_6CH{=}CHCHO$), 2-dodecenal ($CH_3(CH_2)_8CH{=}CHCHO$), 2-hexadecenal ($CH_3(CH_2)_{12}CH{=}CHCHO$), 6-methyl-2-heptenal ($(CH_3)_2CH(CH_2)_2CH{=}CHCHO$), 11-methyl-2-dodecenal ($(CH_3)_2CH(CH_2)_7CH{=}CHCHO$), 2,6-dimethyl-5-heptenal ($(CH_3)_2C{=}CH(CH_2)_2CH\ (CH_3)CHO$) and others.

The imaging device according to the present invention is directed to an imaging device using the electron emitting element according to the present invention as a charger, wherein the electron emitting element emits electrons into the atmosphere to charge an electrostatic latent image carrier. The electron emitting element according to the present invention can stabilize a semiconductor surface of a semiconductor layer by causing an organic compound to be adsorbed on the semiconductor surface to prevent gas molecules in the atmosphere from being adsorbed on the semiconductor surface and to thereby enable a change in electric characteristic and reduction in an electron emission current in the electron emitting element caused by the gas molecules to be suppressed; therefore, the element is used as a charger to thereby enable an electrostatic latent image carrier to be charged.

The imaging device according to the present invention is directed to an imaging device using the electron emitting element according to the present invention as a charge feed device, wherein the electron emitting element is caused to emit electrons in the atmosphere to form a latent image directly on the electrostatic latent image carrier. The electron emitting element according to the present invention can stabilize a semiconductor surface of a semiconductor layer by causing an organic compound to be adsorbed on the semiconductor surface to prevent gas molecules in the atmosphere from being adsorbed on the semiconductor surface and to thereby enable a change in electric characteristic and reduction in an electron emission current in the electron emitting element caused by the gas molecules to be suppressed; therefore, the element is used as a charge feed device to thereby enable a latent image to be formed directly on an electrostatic latent image carrier.

Therefore, the imaging device according to the present invention is constructed as a more simplified imaging device without generating ozone, which has been problematic in a conventional discharge-type charger.

Description will be given of embodiments of the present invention in a concrete manner below based on the accompanying drawing.

EMBODIMENT 1

With reference to FIG. 1, an electron emitting element 11 according to the present invention has a structure in which a porous polysilicon layer as a semiconductor layer 14 is formed on a semiconductor substrate 13*b* made of n-type silicon on the rear surface of which an ohmic electrode 13*a* is formed, an organic compound is caused to be adsorbed on a polysilicon surface of the porous polysilicon layer to form an organic compound adsorption layer 15, and an upper electrode 16 is formed on a surface thereof. Not only is organic compound adsorption layer 15 shown in FIG. 1 formed on a surface of the porous polysilicon layer, but an organic compound adsorption layer is formed on a polysilicon surface in the inside of the porous polysilicon layer, though not shown. Semiconductor substrate 13*b* made of n-type silicon has a high electric conductivity and has a function as a lower electrode 13 integrally in a piece with ohmic electrode 13*a*.

The porous polysilicon layer was prepared by means of the following method. First of all, an undoped polysilicon layer with a thickness of about 1.5 μm was formed on a surface of conductive substrate 13*b* made of n-type silicon by means of a LPCVD (Low Pressure Chemical Vapor deposition) method. Then, a constant current anodic oxidation treatment was applied to the polysilicon layer in a mixed solution of a 50 mass % hydrofluoric acid aqueous solution and ethanol with a mixing ratio of 1 to 1 with the polysilicon layer as a positive electrode and a platinum electrode as a negative electrode to thereby render part or the whole of the polysilicon layer porous and to obtain the porous polysilicon layer. Pore diameters of the porous polysilicon layer were on the order in the range of about 10 nm to 100 nm. Note that a surface of the polysilicon layer is illuminated with light during anodic oxidation treatment using a tungsten lamp of 500 W. At the last stage, the porous polysilicon layer was applied with an RTO (Rapid Thermal Oxidation) treatment at about 900° C. to form an oxide film.

Figure 8:
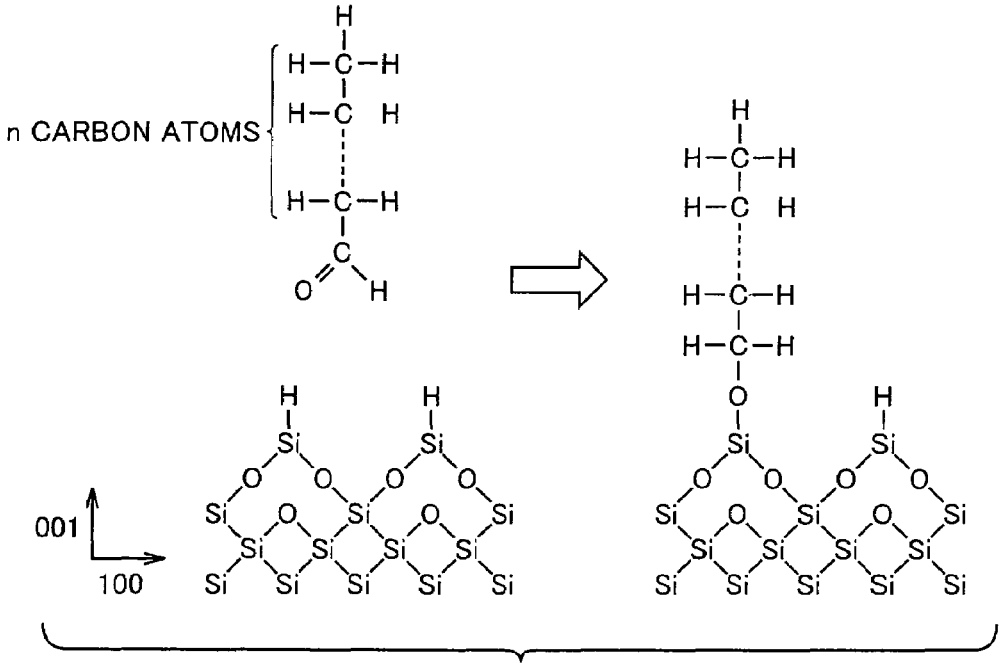
FIG. 8 is a representation illustrating adsorption on a semiconductor surface of an organic compound in the present invention.

Then, an organic compound was caused to be adsorbed on the polysilicon surface of the porous polysilicon layer obtained as described above to thereby form organic compound adsorption layer 15. For example, the element with the porous polysilicon layer was sufficiently dehydrated and thereafter, the element was put into n-decanal ($CH_3(CH_2)_8CHO$) kept at 90° C. The element was kept in n-decanal for about 30 minutes, thereby, as shown in FIG. 8, a reaction occurs between hydrogen terminals remained on the polysilicon surface of the porous polysilicon layer and an aldehyde group of n-decanal and a long chain alkyl group (n=9) of n-decanal is chemically adsorbed on the polysilicon surface to form an organic compound adsorption layer.

In addition, as shown in FIG. 1, a gold electrode thin layer as upper electrode 16 was formed on a surface of organic compound adsorption layer 15 formed to a thickness of about 15 nm on the polysilicon surface of the porous polysilicon layer, which is semiconductor layer 14, by means of a vapor deposition method or a sputtering method to thereby obtain electron emitting element 11 according to the present invention. Note that materials of the electrode thin film layer that can be used include: metals such as gold; in addition thereto, aluminum, tungsten, nickel, platinum, chromium and titanium, and metal oxides such as ITO (Indium Tin Oxide).

Figure 3:
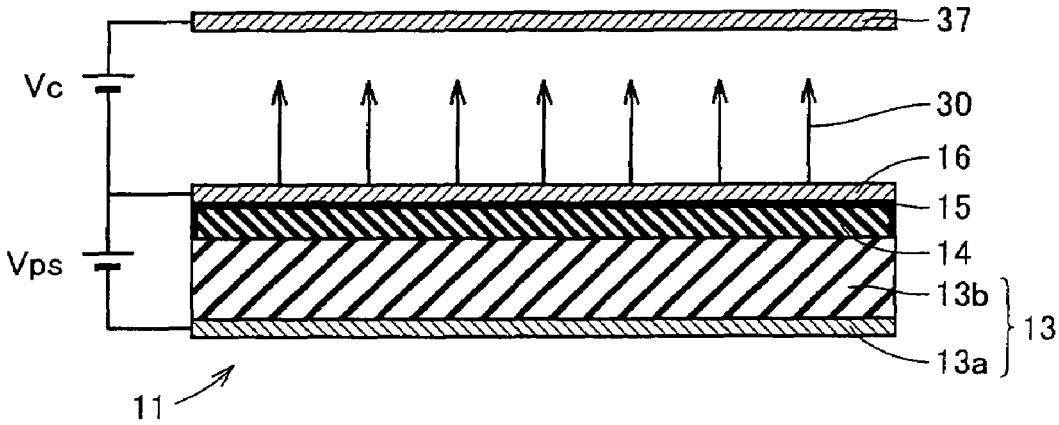
FIG. 3 is a view illustrating a driving method for an electron emitting element according to the present invention.

The electron emitting element fabricated as described above can be driven in a way as described below. That is, with reference to FIG. 3, a collector electrode 37 is arranged at a position opposite upper electrode 16 of electron emitting element 11 with a spacing therebetween of 1 mm, a direct current voltage Vps is applied between upper electrode 16 (positive electrode) and lower electrode 13 (negative electrode), and a direct current voltage Vc of 100 V is further applied between collector electrode 37 and upper electrode 16 to thereby drive the electron emitting element so as to emit electrons 30.

Figure 4:
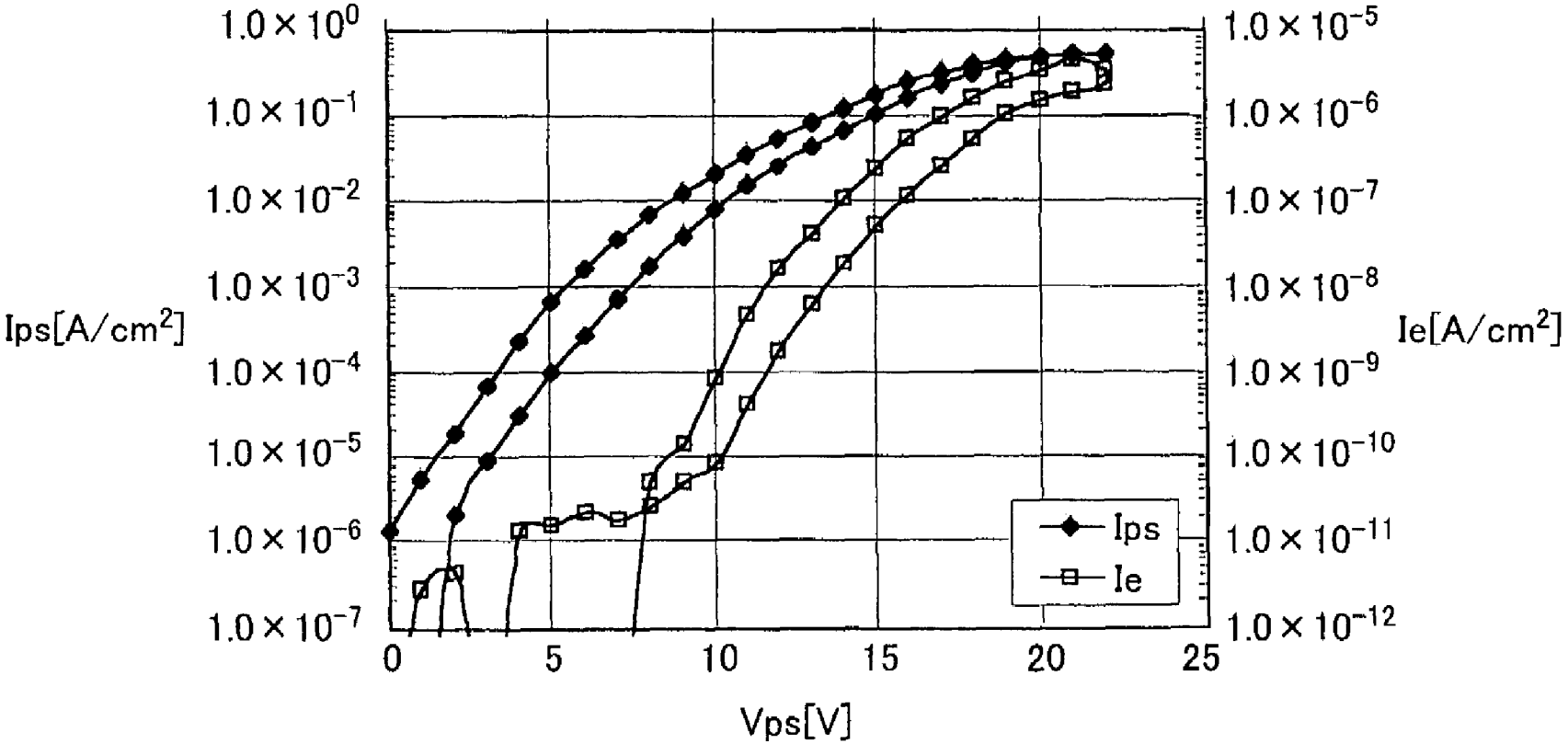
FIG. 4 is a graph showing a current-voltage characteristic of such an electron emitting element according to the present invention.

Measurement was carried out on a diode current Ips flowing between upper electrode 16 and lower electrode 13 and an emission current Ie flowing into collector electrode 37 by electrons emitted from upper electrode 16 and minus ions in the atmosphere and results are shown in FIG. 4. In FIG. 4, the abscissa shows a value of direct voltage Vps applied to the electron emitting element and the ordinate shows a current density on a logarithmic scale, where the rhombus mark indicates diode current Ips and the square mark shows emitted electron current Ie.

As shown in FIG. 4, when element applied voltage Vps was set to 21 V, an emission current Ie of 4.5 $\mu A/cm^2$ was observed despite of operation in the atmosphere. Most of the current is thought to be a current transported to the collector electrode in a state where electrons emitted from the electron emitting element according to the present invention are attached to gas molecules to form minus ions. A current quantity of 4.5 $\mu A/cm^2$ is a current quantity applicable to charging a photosensitive member in an electrophotographic technology used in a laser printer or a digital copying machine and the charge of a photosensitive member can realized in a construction in which collector electrode 37 is replaced with the photosensitive member (not shown) in FIG. 3.

Figure 5:
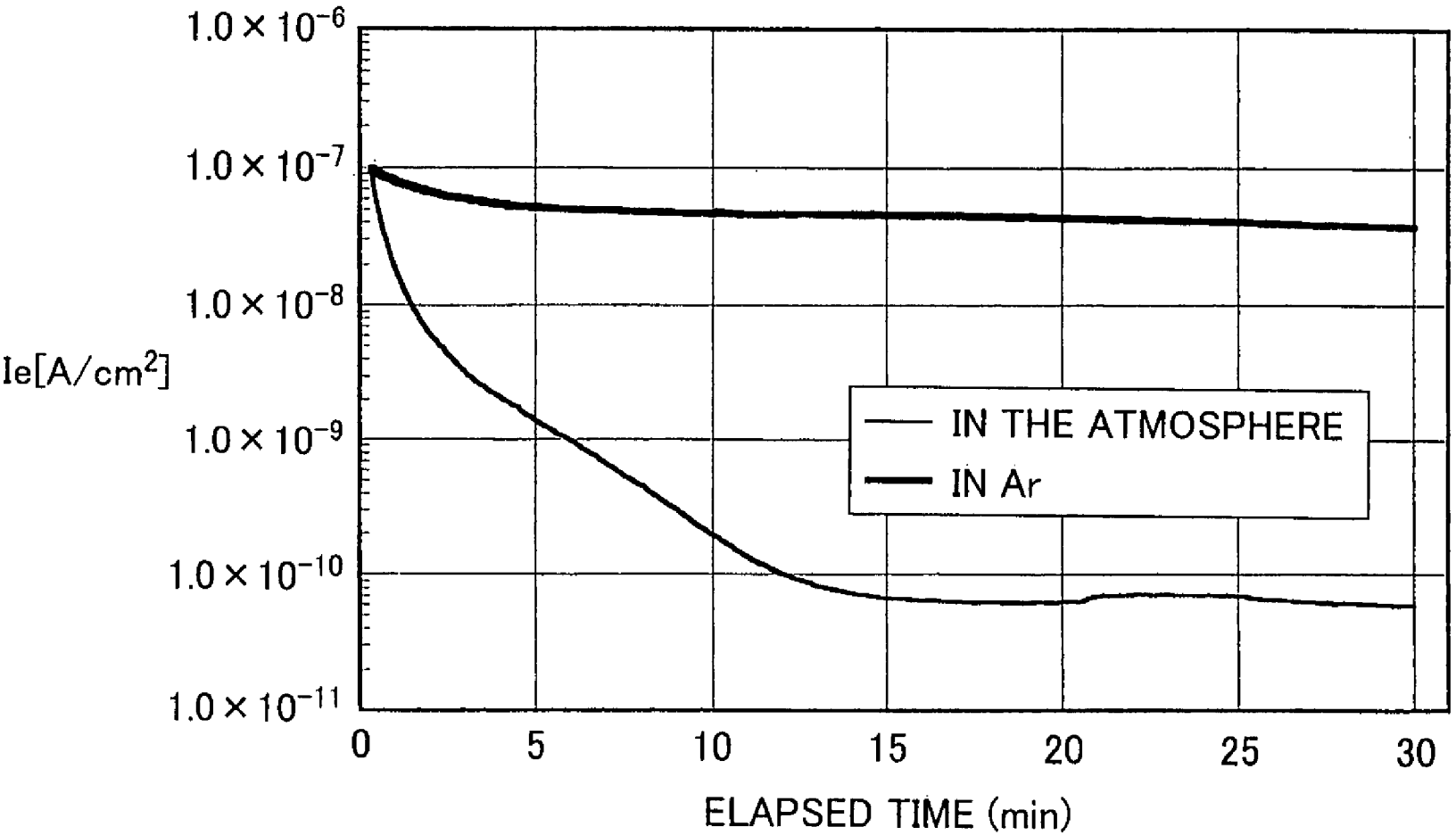
FIG. 5 is a graph showing degradation in characteristic while a conventional electron emitting element is continuously driven.

For the sake of reference, FIG. 5 shows results of measurement on a change in electron emission current quantity while a conventional electron emitting element on which no organic compound was adsorbed on a surface of the semiconductor layer was continuously driven. While an electron emitting element fabricated by means of a method in which an oxide film is formed by RTO after the polysilicon layer is rendered porous by anodic oxidation as described above was continuously driven in the atmosphere and argon (Ar) at the atmospheric pressure, degradation in characteristic was measured, and the results are shown with a fine line and a heavy line, respectively, in FIG. 5. Degradation in argon at the atmospheric pressure is small, whereas current degradation is as great as almost three or more orders of magnitude in the atmosphere than in argon. It is found from the experimental results in Ar that the electron emitting element of the present invention is stably operated without receiving sputtering breakdown caused by ionization of gas molecule even if being operated at the atmosphere. It was found from the experiments in the atmosphere that the element is greatly degraded by an factor or factors other than the sputtering breakdown by ions. That is, it is imagined that in the atmosphere, since various kinds of gas molecules (such as nitrogen, oxygen, carbon dioxide, water, methane, hydrogen, nitrogen oxides and ammonia) that constitute air are adsorbed on a semiconductor surface of a semiconductor layer of an electron emitting element, chemical reaction occurs between the gas molecules and a polysilicon surface of a polysilicon layer, which is a semiconductor layer, especially while the electron emitting element is driven to change a quality of the electron emitting element so as to degrade a characteristic.

A thickness of a metal thin film of upper electrode of an electron emitting element is about 15 nm. An upper electrode of such a thin film is difficult forming a dense thin film without no clearance, which enables various gas molecules in the atmosphere to pass through the upper electrode. Besides, even if a polysilicon layer of an electron emitting element is rendered porous by anodic oxidation and an oxide film is formed thereon by RTO or the like to cover a surface of the polysilicon layer with a thin film of $SiO_2$, the $SiO_2$ film is not dense because of being a thin film and a polysilicon surface having hydrogen terminals remains. Hence, it is imagined that molecules of oxygen, nitrogen and water present in the atmosphere are adsorbed at the hydrogen terminals on the polysilicon layer surface and then, a chemical reaction such as oxidation occurs under influence of a current generated by driving the element, which degrades element characteristic.

Figure 6:
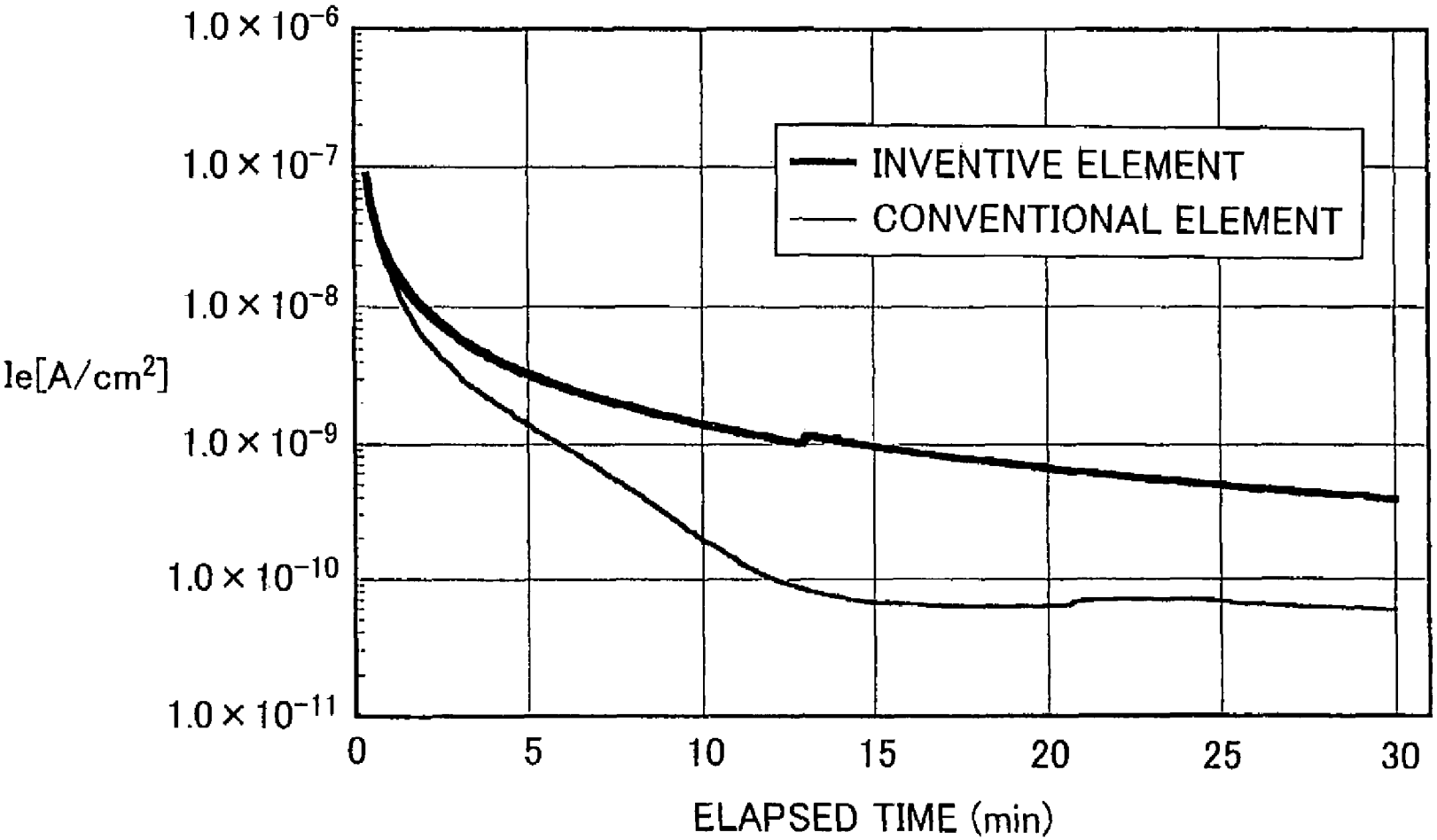
FIG. 6 is a graph showing degradation in characteristic while an electron emitting element according to the present invention and a conventional electron emitting element are continuously driven.

FIG. 6 shows a change in electron emission current quantity as a heavy line while an electron emitting element (an inventive element in the example shown in FIG. 6) according to the present invention having a semiconductor surface of a semiconductor layer on which an organic compound is adsorbed was continuously driven. Note that a fine line of FIG. 6 shows a change in an electron emission current quantity of a conventional electron emitting element (a conventional element in the comparative example shown in FIG. 6) having a semiconductor surface of a semiconductor layer on which no organic compound is adsorbed was continuously driven. As shown in FIG. 6, by adsorbing n-decanal on a semiconductor surface of the semiconductor layer, an electron emission current quantity after 5 minutes was improved by a 0.37 digit in magnitude and an electron emission quantity after 30 minutes was improved by a 0.82 digit of magnitude.

It is imagined that since an organic compound is adsorbed on the semiconductor surface of a semiconductor layer to thereby form an organic compound adsorption layer obtained by replacing hydrogen terminals of polysilicon present on the semiconductor surface with alkyl groups, an electron emission characteristic of the electron emitting element can be stabilized. That is, it is imagined that by causing long chain alkyl groups to be adsorbed on the semiconductor surface of a semiconductor layer, the semiconductor surface of a semiconductor layer can be protected from adsorption of various gas molecules in the atmosphere and the quasi-active semiconductor surface easy to react with gas molecules (hydrogen terminals or the like on the polysilicon semiconductor surface) can be subjected to chemical adsorption with an organic compound and stabilized; therefore, degradation while continuous driving can be overcome. Besides, it is inferred that since long chain alkyl groups exert hydrophobicity, the alkyl groups prevent adsorption of water and excessive progress in oxidation, thereby stabilizing the element.

As described above, by causing an organic compound to be absorbed on a semiconductor surface of a semiconductor layer to form an organic compound adsorption layer, an electron emitting element operating stably for a long time in the atmosphere can be realized.

EMBODIMENT 2

Figure 7:
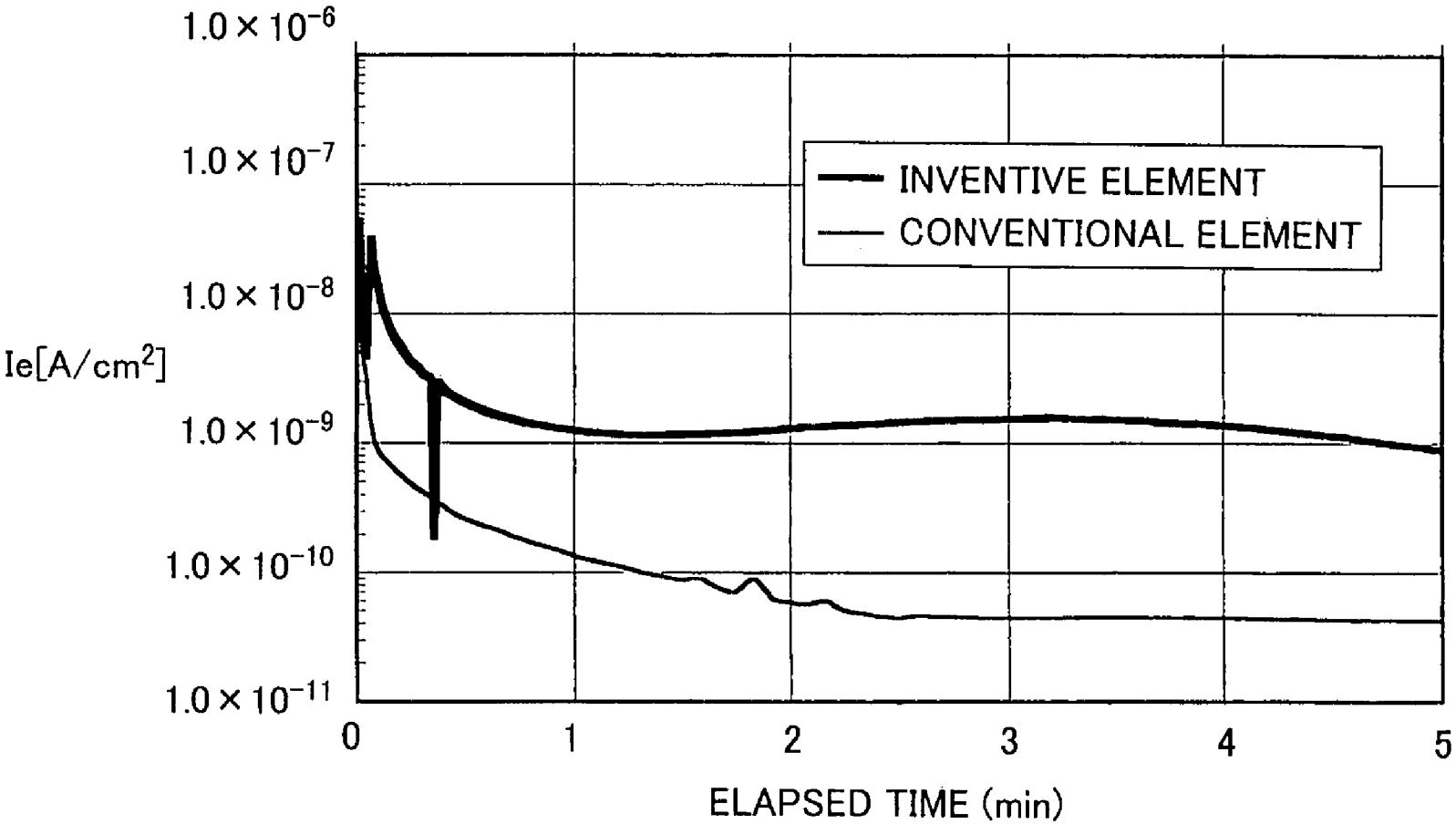
FIG. 7 is a graph showing degradation in characteristic while another electron emitting element according to the present invention and a conventional electron emitting element are continuously driven.

Another electron emitting element according to the present invention (an inventive element in the example shown in FIG. 7) was fabricated in a similar way to that in Embodiment 1 with the exception that n-dodecanal ($CH_3(CH_2)_{10}CHO$) was used when an organic compound is adsorbed on a polysilicon surface of a porous polysilicon layer. FIG. 7 shows a change in electron emission current quantity with a heavy line while the inventive element was continuously driven in a similar way to that in Embodiment 1. A fine line in FIG. 7 shows a change in electron emission quantity of a conventional electron emitting element having a semiconductor surface of a semiconductor layer on which no organic compound is adsorbed (a conventional element in the comparative example of FIG. 7) with a fine line while the conventional element was operated continuously in the same way. As shown in FIG. 7, by causing n-dodecanal to be absorbed on a surface of a semiconductor layer, an electron emission current quantity after 5 minutes is increased by 1.32 digits in magnitude.

EMBODIMENT 3

Figure 9:
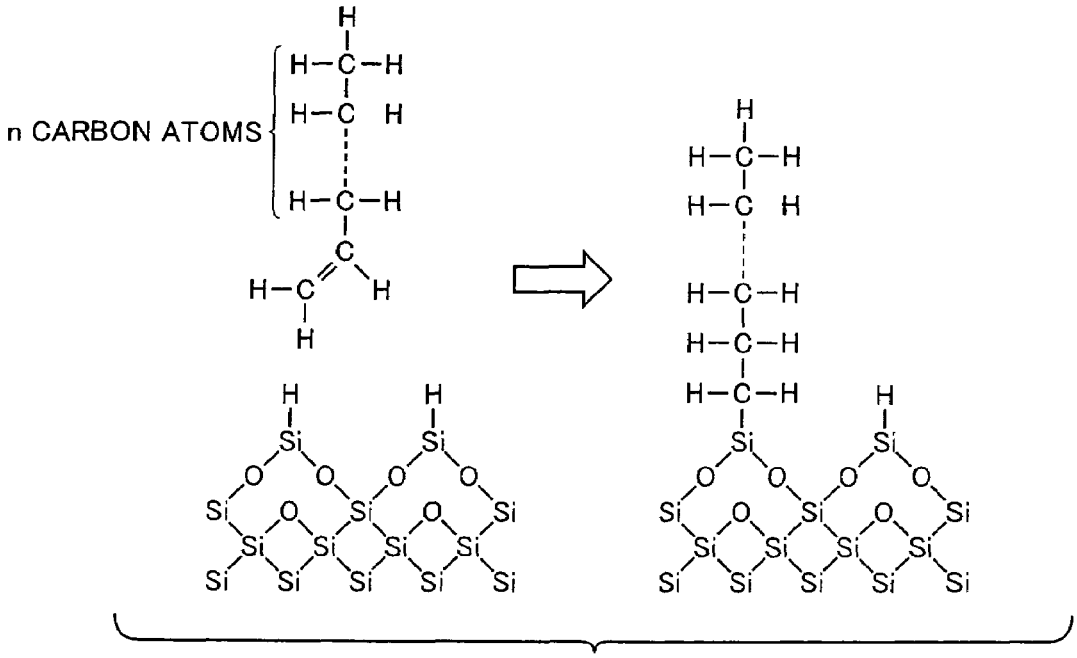
FIG. 9 is a representation illustrating adsorption on a semiconductor surface of another organic compound in the present invention.

Electron emitting element 11 according to the present invention was obtained in a similar way to that in Embodiment 1 with the exception that 1-decene ($CH_3(CH_2)_7CH{=}CH_2$) was used when an organic compound was caused to be adsorbed on a silicon surface of a porous polysilicon layer. By adsorption of 1-decene to the silicon surface of a porous polysilicon layer, a reaction occurs, as shown in FIG. 9, between hydrogen terminals remaining on the porous polysilicon surface and a vinyl group of 1-decene and as a result, a long chain alkyl group (n=9) of 1-decene is chemically adsorbed on the polysilicon surface to thereby form an organic compound adsorption layer.

Note that an adsorption state of an organic compound, that is a state of an organic compound adsorption layer, on the silicon surface can be analyzed with DRIFT (Diffuse Reflectance Infrared Fourier-transform), Auger electron spectroscopy, Raman spectroscopy or the like.

EMBODIMENT 4

With reference to FIG. 2, another electron emitting element 21 according to the present invention has a structure in which a lower electrode 23 is formed on a surface of an insulating substrate 22 made of glass, a porous polysilicon layer is formed as a semiconductor layer 24 thereon, an organic compound is caused to be adsorbed on a polysilicon surface of the porous polysilicon layer to form an organic compound adsorption layer 25, and an upper electrode 26 is further formed on the surface. In this case, not only is organic compound adsorption layer 25 shown in FIG. 2 formed on the surface of the porous polysilicon layer, but an organic compound layer, though not shown, is also formed on a polysilicon surface in the inside of the porous polysilicon layer. Materials of lower electrode 23 on insulating substrate 22 made of glass that can be used are, for example, metals such as aluminum, tungsten, gold, nickel, platinum, chromium, titanium and others; metal oxides such as ITO. Lower electrode 23 is formed by means of a vapor deposition method or a sputtering method.

The porous polysilicon layer on the surface of insulating substrate 22 on which lower electrode 23 was formed was formed according to a method described below. An undoped polysilicon layer with a thickness of about 1.5 μm was formed on a surface of lower electrode 23 formed on the surface of insulating substrate 22 made of glass by means of an LPCVD method. Then, a constant current anodic oxidation treatment was applied on the polysilicon layer in a mixed solution of a 50 mass % hydrogen fluoride aqueous solution and ethanol with a mixing ratio of 1 to 1 with the polysilicon layer as a positive electrode and a platinum electrode as a negative electrode to thereby render part or the whole of the polysilicon layer porous to obtain the porous polysilicon layer. Pore diameters in the porous polysilicon layer were on the order in the range of from about 10 nm to 100 nm. Note that a surface of the silicon layer was illuminated with light from a tungsten lamp with the output of 500 W during anodic oxidation. Finally, a constant current was fed in an about 10% dilute sulfuric acid with the silicon substrate as a positive electrode and a platinum electrode as a negative electrode to thereby apply an ECO (Electrochemical Oxidation) treatment to the silicon substrate and to form an oxide film. In a fabrication process with such an ECO treatment, a process temperature is low, which alleviates a restraint on a substrate material, thereby enabling glass as a substrate material to be used. Besides, since, directly subsequent thereto, the porous polysilicon layer can be oxidized with a wet treatment, the process can be simplified as compared with oxidation in rapid thermal oxidation.

In a similar way to that in Embodiment 1, an organic compound adsorption layer was formed on the polysilicon surface of the porous polysilicon layer and thereafter, the upper electrode was formed thereon.

EMBODIMENT 5

Figure 10:
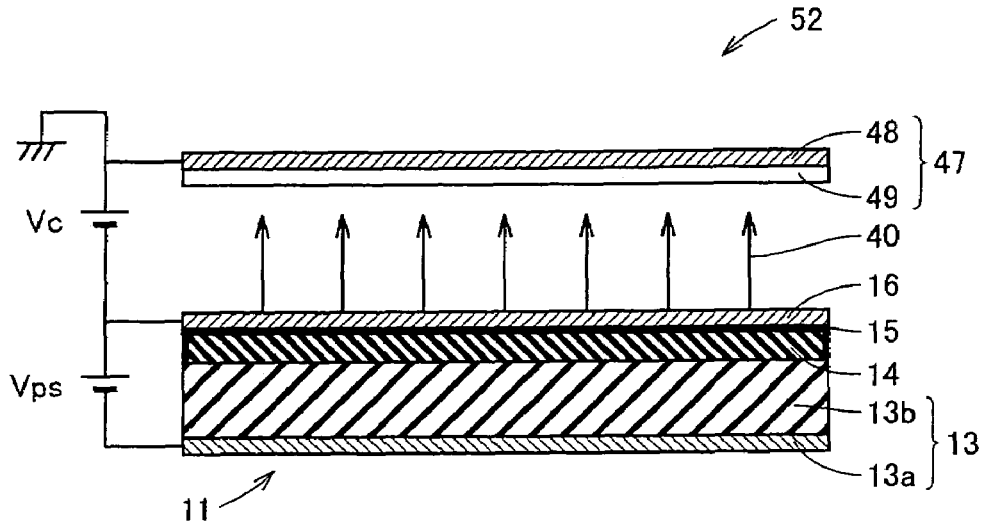
FIG. 10 is a schematic view showing a charger using an electron emitting element according to the present invention.

With reference to FIG. 10, a charger 52 using an electron emitting element according to the present invention has a structure in which a photosensitive member 47 constituted of an electrode 48 and a photosensitive layer 49 is disposed at a position opposite upper electrode 16 of electron emitting element 11. A spacing between upper electrode 16 of electron emitting element 111 and photosensitive member 47 is set to 1 mm and the photosensitive member was charged in conditions that a collector voltage Vc is set to 800 V and the voltage Vps applied to the element is set to 20 V. Since an ion transport electric field is formed in a space above upper electrode 16 while a charge operation is carried out, emitted electrons 40 are efficiently transported to the photosensitive member. It is inferred that since electrons are emitted in the atmosphere, a great part of the emitted electrons are attached to gas molecules in the atmosphere and such electrons are transported as minus ions. The electron emitting element according to the present invention with such a construction having the semiconductor layer on the surface of which an organic compound was adsorbed was driven and thereby, the surface of the photosensitive member was able to be charged to a value in the vicinity of 800 V.

EMBODIMENT 6

Detailed description will be given of an imaging device using the electron emitting element according to the present invention as a charger.

Figure 11:
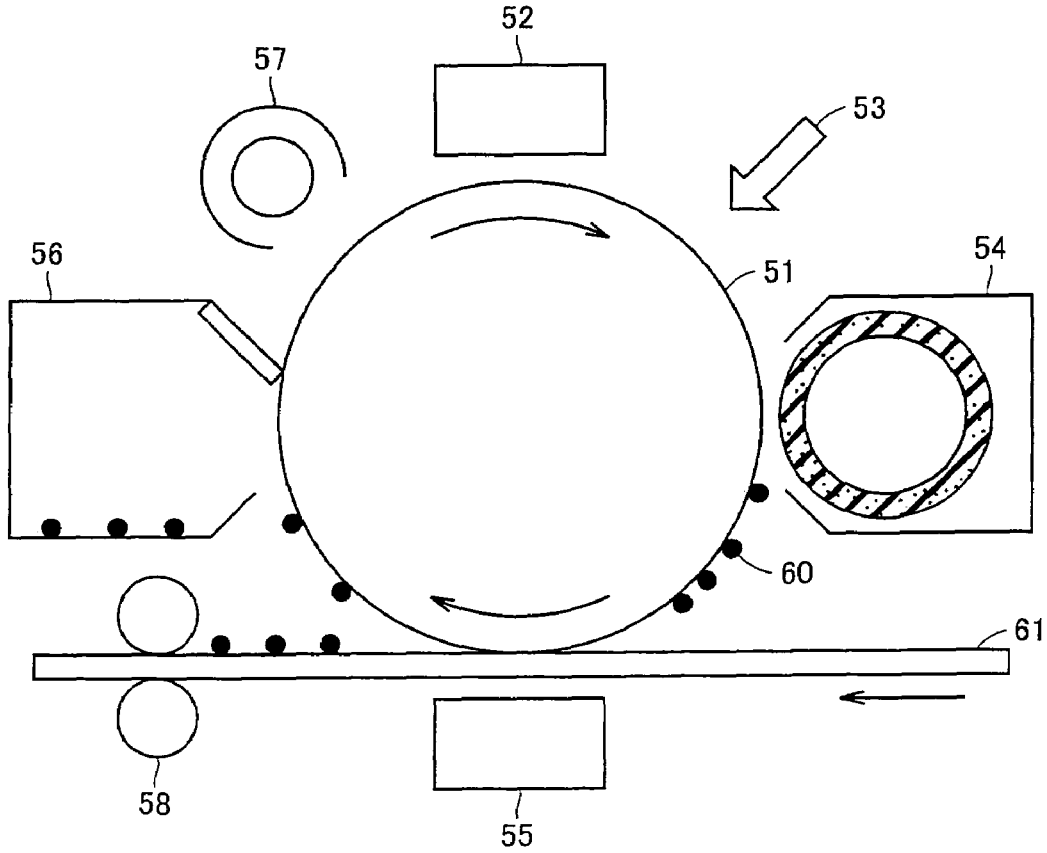
FIG. 11 is a schematic view showing an imaging device using an electron emitting element according to the present invention as a charger.

First of all, with reference to FIG. 11, description will be given of an outline of a construction of the imaging device. A photosensitive member 51 is disposed almost in the middle of the imaging device proper and constitutes a latent image carrier carrying an electrostatic latent image formed in the shape of a drum rotation-driven at a constant speed in a direction of an arrow mark during an imaging operation. Various kinds of devices carrying out an imaging process are arranged opposite the outer surface of photosensitive member 51.

The devices implementing the imaging process include: a charger 52 charging the surface of photosensitive member 51 uniformly; an optical system in which the surface of photosensitive member 51 is imagewise illuminated with exposure light 53 according to an image not shown; a developing device 54 for visualizing the electrostatic latent image formed on the surface of photosensitive member 51 by exposure with the optical system; a transferring device 55 transferring the developed image (that is, an image of toner 60) onto a sheet-like paper 61 appropriately transported; a cleaning device 56 removing a residual developing agent (residual toner) not transferred onto the surface of photosensitive member 51 after the transfer; and a charge removing device 57 removing electrostatic charge remaining on the surface of photosensitive member 51, which are installed in this order in a rotational direction of photosensitive member 51.

Many of Papers 61 are accommodated in, for example, a tray or a cassette and accommodated papers are fed one piece at a time by a feeding means to a transfer region, opposite photosensitive member 51 at a position where transferring device 55 is installed, so that the paper coincides with the leading edge of the toner image formed on the surface of photosensitive member 51. Paper 61 after the transfer is separated from photosensitive member 51 and further fed to a fixing device 58.

Fixing device 58 fixes an unfixed toner image transferred onto a paper as a permanent image, and includes a heat roller the surface opposite the toner image of which is heated to a temperature melting and fixing the toner, and a press roller bringing paper 61 pressed to the heat roller so as to be in close contact with the heat roller side. Paper 61 passing through the fixing device 58 is discharged outside the imaging device onto a discharge tray not shown through discharging rollers.

The optical system not shown launches an optical image on-off driven according to image data using a semiconductor laser since an imaging device of the present invention is a printer or a digital copying machine. Especially in a digital copying machine, reflecting light from a manuscript for copying is read by an image reading sensor such as a CCD element is inputted to the optical system including the semiconductor laser and then, an optical image according to image data is outputted. In a printer, image data from other processing devices such as a word processor and a personal computer is converted to an optical image and paper is illuminated with the optical image. The conversion to the optical image is carried out using not only a semiconductor laser but also an LED element or a liquid crystal shutter.

In the way described above, if an imaging operation in the imaging device gets started, photosensitive member 51 is rotation-driven in the direction of the arrow mark and the surface of photosensitive member 51 is uniformly charged to a potential with a specific polarity by charger 52. After the charge, an optical image is launched by exposure light 53 in the optical system not shown and an electrostatic latent image according to the optical image is formed on the surface of photosensitive member 51. Developing is carried out in next developing device 54 to visualize the electrostatic latent image. In one imaging device according to the present invention, the developing is one with toner of one component and the toner is selectively attracted by an electrostatic force to an electrostatic latent image formed on the surface of photosensitive member 51 to thereby complete developing.

A toner image thus developed on the surface of photosensitive member 51 is electrostatically transferred onto paper 61 transported properly in synchronism with the rotation of photosensitive member 51 with transferring device 55 disposed in a transfer region. The transfer is performed by causing the toner image to migrate to the paper 61 side while transferring device 55 charges the rear surface of paper 61 with a polarity opposite a polarity of toner charge. After the transfer, part of the toner image not transferred to the surface of photosensitive member 51 is left behind thereon, the residual toner is removed from the surface of photosensitive member 51 with cleaning device 56 and the charge on the surface of photosensitive member 51 is removed to a uniform potential thereon, for example almost zero potential by charge removing device 57 for reuse of photosensitive member 51.

On the other hand, paper 61 on which the transfer has been completed is separated from photosensitive member 51 and paper 61 is transported to fixing device 58. In fixing device 58, the toner image on paper 61 is melted and press-adhered on paper 61 by a pressure acted thereon between the rollers. Paper 61 having passed through fixing device 58 is discharged into a discharge tray or the like installed outside the imaging device as the paper on which imaging is completed.

A charger using corona discharge as a working principle has generally used heretofore as charger 52 of an imaging device of an electrophotography type. To be concrete, there has been known a wire charge scheme using tungsten wire with a diameter of the order of 60 μm to which a high voltage is applied; a saw teeth charger scheme applying a high voltage to a plurality of saw teeth each having a sharply pointed tip; a roller charging scheme applying a high voltage to the roller put into contact with a photosensitive member and others, whereas since any of the schemes is a charger using discharge as a principle, it has been problematic to generate much of ozone. In a case where electron emitting element 11 according to the present invention is used as charger 52 of FIG. 11, discharge is not a principle but electron emission is a principle, thereby enabling an imaging device capable of avoiding generation of ozone to be provided.

EMBODIMENT 7

Then, detailed description will be given of an imaging device using such an electron emitting element according to the present invention as a charge feeding device. As described above, it has been common that a method in which a photosensitive member is uniformly charged, exposure with a light beam is carried out to thereby form an electrostatic image, while it is also possible that ions are supplied directly onto an insulating material or a photosensitive member with a charge feed device such as Ion Printing Technology to thereby form an electrostatic latent image. Such a direct latent image forming scheme can simplify conventional two processes of charge and exposure into one process, which is advantageous for down sizing of an imaging device. In a case where an electrostatic latent image carrier is a photosensitive member, there are a problem of restraint on material and wear and another problem of dielectric break-down in a film; therefore, design items such as a film thickness and a dielectric item cannot be greatly altered, while in a case where a direct latent image forming scheme with a charge feed device, a photosensitive member is not necessarily required as an electrostatic latent image carrier, but a common insulating material can be used as the carrier. Hence, a freedom in material selection can be enhanced. Thereby, wear resistance and a resolution of an electrostatic latent image carrier can be improved.

Figure 12:
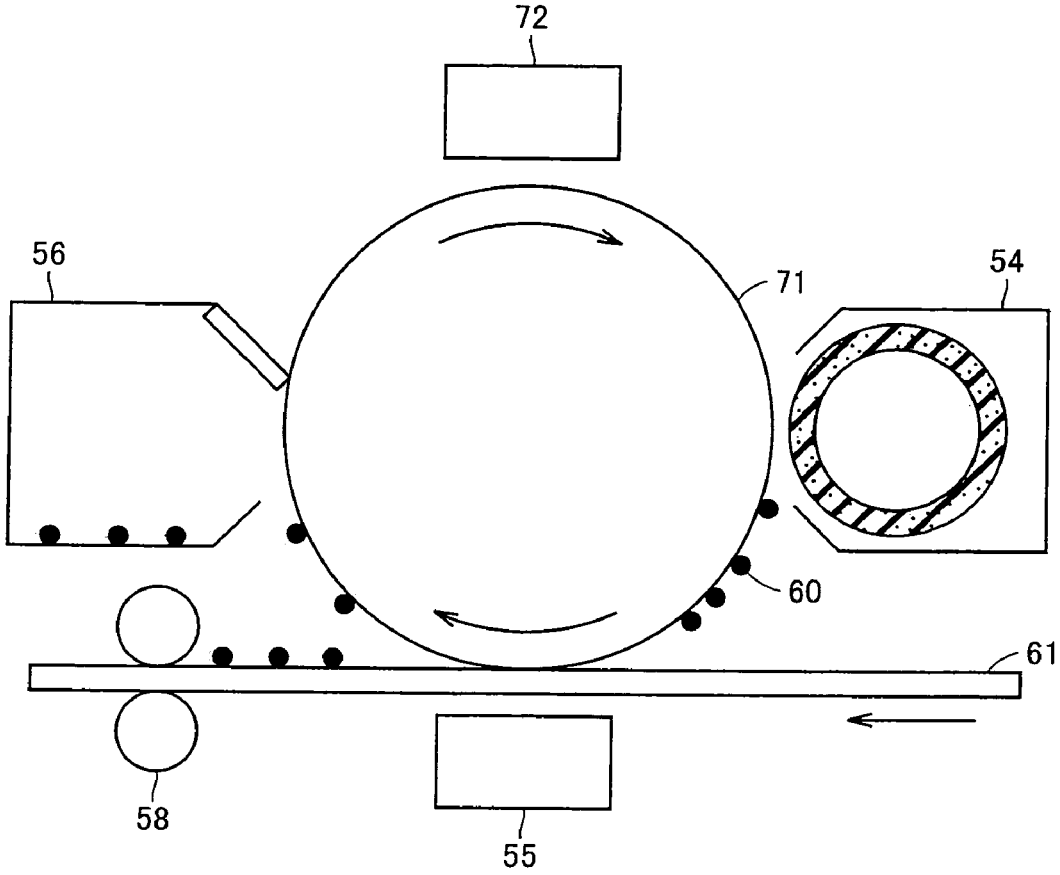
FIG. 12 is a schematic view showing an imaging device using an electron emitting element according to the present invention as a charge feed device.

With reference to FIG. 12, description will be given of an outline of an imaging process in a case where a charge feed device 72 capable of direct latent image formation is used. A difference between the imaging process using a conventional photosensitive member shown in FIG. 11 and the case of FIG. 12 is that an electrostatic latent image carrier changes from photosensitive member 51 to a dielectric drum 71, and the three constituents of charger 52, exposure light 53 and a charge removing device 57 are replaced with a charge feed device 72. It is only a difference that an electrostatic latent image forming method changes from a combination of a photosensitive member and light to a method supplying ions or electrons directly and other processes associated therewith are similar. Note that an electrostatic latent image carrier is not necessary required to be a dielectric drum but may be a conventional photosensitive member.

Figure 13:
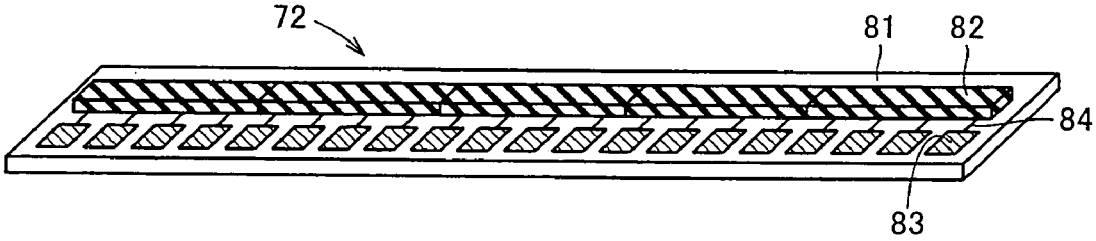
FIG. 13 is a schematic view showing a charge feed device using an electron emitting element according to the present invention.

FIG. 13 shows a schematic view showing a structure of charge feed device 72. A substrate 81 is constituted of a silicon substrate or a glass plate having a porous polysilicon layer on a polysilicon surface of which an organic compound is adsorbed. A plurality of electron emitting element sections 83 are arranged on substrate 81. The outermost surfaces of electron emitting element sections 83 are constituted of thin film upper electrodes and are connected by a driver IC 82 for selectively drive-controlling the plurality of elements and wires 84. With the charge feed device with such a structure adopted, ions or electrons are supplied directly onto dielectric drum 71 of FIG. 12, thereby enabling an arbitrary electrostatic latent image to be written. Since FIG. 13 is a diagram of an outline of the structure, only 20 electron emitting element sections are written, while in an actual case, a plurality of elements are arranged at a density of 600 DPI (Dots per Inch) across a length of about 300 mm to thereby enable an electrostatic latent image for a printer or a copying machine capable of handling a paper size as large as A3 to be formed.

Since a conventional charge feed device generates ions by discharge as a principle in a similar way to that in a conventional charger, a problem has arisen that generates much of ozone. By using an electron emitting element of the present invention as charge feed device 72 of FIG. 13, not only can generation of ozone be avoided since discharge is not a principle, but electron emission is a principle, but an imaging device simplified by direct latent image formation with a charge feed device can also be provided.

EXAMPLES 1 TO 9

An improved number of digits in magnitude of electron emission quantity was checked in a case where an organic compound shown in Table 1 is caused to be adsorbed on a semiconductor surface of a semiconductor layer in conditions similar to those of Embodiment 1. Examples 1, 2 and 4 correspond to Embodiments 1, 2 and 3, respectively.

TABLE 1

| | | Example 1 | Example 2 | Example 3 | Example 4 | Example 5 |
|---|---|---|---|---|---|---|
| Classification | | Aldehyde group | Aldehyde group | Aldehyde group | Unsaturated bond | Unsaturated bond |
| Organic compound | | n-Decanal | n-Dodecanal | n-Octanal | 1-Decene | 1-Dodecene |
| Chemical formula | | $CH_3(CH_3)_8CHO$ | $CH_3(CH_2)_{10}CHO$ | $CH_3(CH_2)_6CHO$ | $CH_3(CH_2)_7CH{=}CH_2$ | $CH_3(CH_2)_9CH{=}CH_2$ |
| Improved number of digits in magnitude of electron emission | After 5 min. of discharge | 0.37 | 1.32 | | | |
| | After 30 min. of discharge | 0.82 | | 0.45 | 2.02 | 1.25 |

TABLE 1-continued

| current quantity | | Example 6 | Example 7 | Example 8 | Example 9 |
|---|---|---|---|---|---|
| Classification | | Unsaturated bond | Two unsaturated bonds | Branched & unsaturated bond | Unsaturated bond & aldehyde group |
| Organic compound | | 1-Hexadecene | 1,7-Octadiene | 2,4-Dymethyl-1-heptene | 2,6-Dymethyl-5-heptenal |
| Chemical formula | | $CH_3(CH_2)_{13}CH{=}CH_2$ | $CH_2{=}CH(CH_2)_4CH{=}CH2$ | $CH_3(CH_2)_2CH(CH_3)CH_2C(CH_3){=}CH_2$ | $(CH_3)_2C{=}CH(CH_2)_2CH(CH_3)CHO$ |
| Improved number of digits in magnitude of electron emission current quantity | After 5 min. of discharge | 0.53 | 1.18 | 0.65 | 0.46 |
| | After 30 min. of discharge | | | | |

As shown in Table 1, by causing a compound obtained by coupling at least aldehyde group to a non-cyclic hydrocarbon or a non-cyclic hydrocarbon having at least one unsaturated bond to be adsorbed on a semiconductor surface of a semiconductor layer, an electron emission quantity is increased by 0.37 to 2.02 digits in magnitude.

Although the present invention has been described and illustrated in detail, it is clearly understood that the same is by way of illustration and example only and is not to be taken by way of limitation, the spirit and scope of the present invention being limited only by the terms of the appended claims.

INDUSTRIAL APPLICABILITY

The present invention, as described above, can be widely used in an electron emitting element and an imaging device using the same.

The invention claimed is:

1. An electron emitting element of a structure in which a semiconductor layer is formed between an upper electrode and a lower electrode, wherein an organic compound adsorption layer is formed on a semiconductor surface of said semiconductor layer by causing a organic compound to be adsorbed on the semiconductor surface.

2. The electron emitting element according to claim 1, wherein said semiconductor layer is made of silicon and a porous silicon semiconductor layer part or the whole of which is porous.

3. The electron emitting element according to claim 1, wherein said semiconductor layer is made of polysilicon and a porous polysilicon semiconductor layer part or the whole of which is porous.

4. The electron emitting element according to claim 1, wherein said organic compound is a non-cyclic hydrocarbon.

5. The electron emitting element according to claim 4, wherein said non-cyclic hydrocarbon is a straight-chain or branched non-cyclic hydrocarbon having 7 or more carbon atoms in a molecule.

6. The electron emitting element according to claim 4, wherein said non-cyclic hydrocarbon has at least one unsaturated bond in a molecule.

7. The electron emitting element according to claim 6, wherein said non-cyclic hydrocarbon having the unsaturated bond is a straight-chain or branched non-cyclic hydrocarbon expressed by $C_nH_{2n}$ (n: an integer ranging from 7 to 17).

8. The electron emitting element according to claim 1, wherein said organic compound is a compound obtained by coupling at least an aldehyde group to a non-cyclic hydrocarbon.

9. The electron emitting element according to claim 8, wherein said non-cyclic hydrocarbon is a straight-chain or branched non-cyclic hydrocarbon having 7 or more carbon atoms in a molecule.

10. The electron emitting element according to claim 8, wherein said compound obtained by coupling an aldehyde group to a non-cyclic hydrocarbon is a straight-chain or branched saturated aldehyde compound expressed by $C_nH_{2n+1}CHO$ (n: an integer ranging from 7 to 17).

11. The electron emitting element according to claim 8, wherein said compound obtained by coupling an aldehyde group to a non-cyclic hydrocarbon is a straight-chain or branched non-cyclic unsaturated aldehyde compound expressed by $C_nH_{2n-1}CHO$ (n: an integer ranging from 7 to 17).

12. An imaging device using, as a charger, an electron emitting element of a structure in which a semiconductor layer is formed between an upper electrode and a lower electrode, and an organic compound adsorption layer is formed on a semiconductor surface of said semiconductor layer by causing a organic compound to be adsorbed on the semiconductor surface, wherein an electrostatic latent image carrier is charged by emitting electrons from said electron emitting element in the atmosphere.

13. An imaging device using, as a charge feed device, an electron emitting element of a structure in which a semiconductor layer is formed between an upper electrode and a lower electrode, and an organic compound adsorption layer is formed on a semiconductor surface of said semiconductor layer by causing a organic compound to be adsorbed on the semiconductor surface, wherein a latent image is formed directly on an electrostatic latent image carrier by emitting electrons from said electron emitting element in the atmosphere.

* * * * *